United States Patent [19]

Onembo

[11] 4,244,314

[45] Jan. 13, 1981

[54] AUXILIARY FEED STITCH REGULATOR MECHANISM

[75] Inventor: Eli N. Onembo, Clark, N.J.

[73] Assignee: The Singer Company, Stamford, Conn.

[21] Appl. No.: 97,600

[22] Filed: Nov. 26, 1979

[51] Int. Cl.[3] ..... D05B 27/08

[52] U.S. Cl. ..... 112/313

[58] Field of Search ..... 112/313, 312, 315, 303

[56] References Cited

U.S. PATENT DOCUMENTS

| | | | |
|---|---|---|---|
| 3,611,817 | 10/1971 | Smith et al. | 112/313 |
| 4,027,609 | 6/1977 | Kerr | 112/313 |
| 4,095,540 | 6/1978 | Kattenbach et al. | 112/315 |
| 4,140,020 | 2/1979 | Travaglini | 11 2/313 |

*Primary Examiner*—H. Hampton Hunter

*Attorney, Agent, or Firm*—Edward P. Schmidt; Robert E. Smith; Edward L. Bell

[57] ABSTRACT

An auxiliary feed regulator for a differential feed mechanism, which auxiliary regulator may be manipulated by a sewing machine operator during sewing without feed back or vibration to the operator. An auxiliary regulator foot treadle may be connected to an auxiliary feed actuating lever by the usual chain, the feed actuating lever being formed with a slot for receiving a stud carried by a one end of a connecting link, the other end of which is operatively associated with a slider carried by an auxiliary feed rock lever. The slot in the feed actuating lever extends in a direction to give the greatest distance from the pivotal connection of the feed actuating lever and from the slider at the extreme thereof effective during feed motion and to the least distance therefrom at the extreme thereof effective for return motion. This construction permits restraint against motion during the feeding motion of the cycle, and permits some motion to take place during the return motion of the sewing machine feed dog without transmission of the motion to the feed actuating lever and thereby to the sewing machine operator.

3 Claims, 3 Drawing Figures

AUXILIARY FEED STITCH REGULATOR MECHANISM

DESCRIPTION

BACKGROUND OF THE INVENTION

This invention relates to sewing machines; more particularly, to an auxiliary feed stitch regulating mechanism for a sewing machine having a differential feed capability.

There is a class of industrial sewing machines having a differential feed capability wherein the feeding rate of the main feed dog is set by one stitch length regulator and the feeding rate of an auxiliary feeding dog is set by a second stitch regulator which, generally, increases the feed obtainable from the sewing machine feed rock shaft. In most cases, the auxiliary feed dog is carried by a rod slidable in bosses extending from the main feed dog carrier so as to maintain both feed dogs in rising and falling synchronism. The auxiliary feed stitch regulator thus drives the rod carrying the auxiliary feed dog relative to the main feed dog carrier in order to, for example, create a pucker in the work material of variable degrees for decorative or utilitarian purposes. In many industrial sewing machines, the feed ratio between the auxiliary feed dog and the main feed dog is generally adjusted to a position and maintained there. However, in certain cases, it is desirable to provide a way for an operator to vary the ratio between the auxiliary feed and the main feed in order that a greater variety of stitching possibilities may be accommodated. In these types of machines, the auxiliary feed stitch regulator mechanism may be varied while the sewing machine is operating by means of a treadle control which adjusts the amount of motion derived from the feed rock shaft. One of the problems encountered with this type of device is a feedback from the rock shaft to the foot of the sewing machine operator by the treadle which, at best, is annoying, generates operator fatigue and may actually affect the appearance of the work material in having a non-uniform gather.

What is required is some means of isolating, insofar as possible, the vibration of the rock shaft from the operator of the sewing machine so as to avoid the feedback to the operator of the motion of the rock shaft and the variability in the product that may result from an operator's response to this feedback.

SUMMARY OF THE INVENTION

The above requirements are met in an auxiliary feed stitch regulator mechanism with an auxiliary feed actuating lever operably connected to a foot treadle. Auxiliary feed regulation is obtained by selectively positioning a slide block along a radially disposed slot in an auxiliary feed rock lever carried by the sewing machine feed rock shaft. The slide block is carried by a driving crank link operably connected to the auxiliary feed, and also having a connection to the auxiliary feed actuating lever so as to permit selective positioning of the slide block. The connection to the auxiliary feed actuating lever is effected by a connecting length which is pivotally connected to the driving crank link and has a pin connection to the feed actuating lever in a slot thereof, the slot being at an angle thereto. Oscillation of the sewing machine feed rock shaft is transferred to the auxiliary feed rock lever causing the slide block to move in an arc and drive the crank link so as to obtain an increment of feed motion. The feed motion may be altered by moving the slide block closer to or further away from the center of oscillation by manipulating the foot treadle, and thereby the auxiliary feed actuating lever. The arcuate motion of the auxiliary feed rock lever and the slide block thereof has a component thereof which is transferred through the crank link to the connecting link, and would normally be felt in the auxiliary feed actuating lever but for the slot connection therein to the connecting link which permits the dissipation of this motion in a fashion not possible if the pin connecting the connecting link and feed actuating lever were to extend through a relatively close tolerance hole.

BRIEF DESCRIPTION OF THE DRAWINGS

In order that the invention may be more fully understood, it will now be described, by way of example, with reference to the accompanying drawings in which.

DESCRIPTION OF A PREFERRED EMBODIMENT

Figure 1:
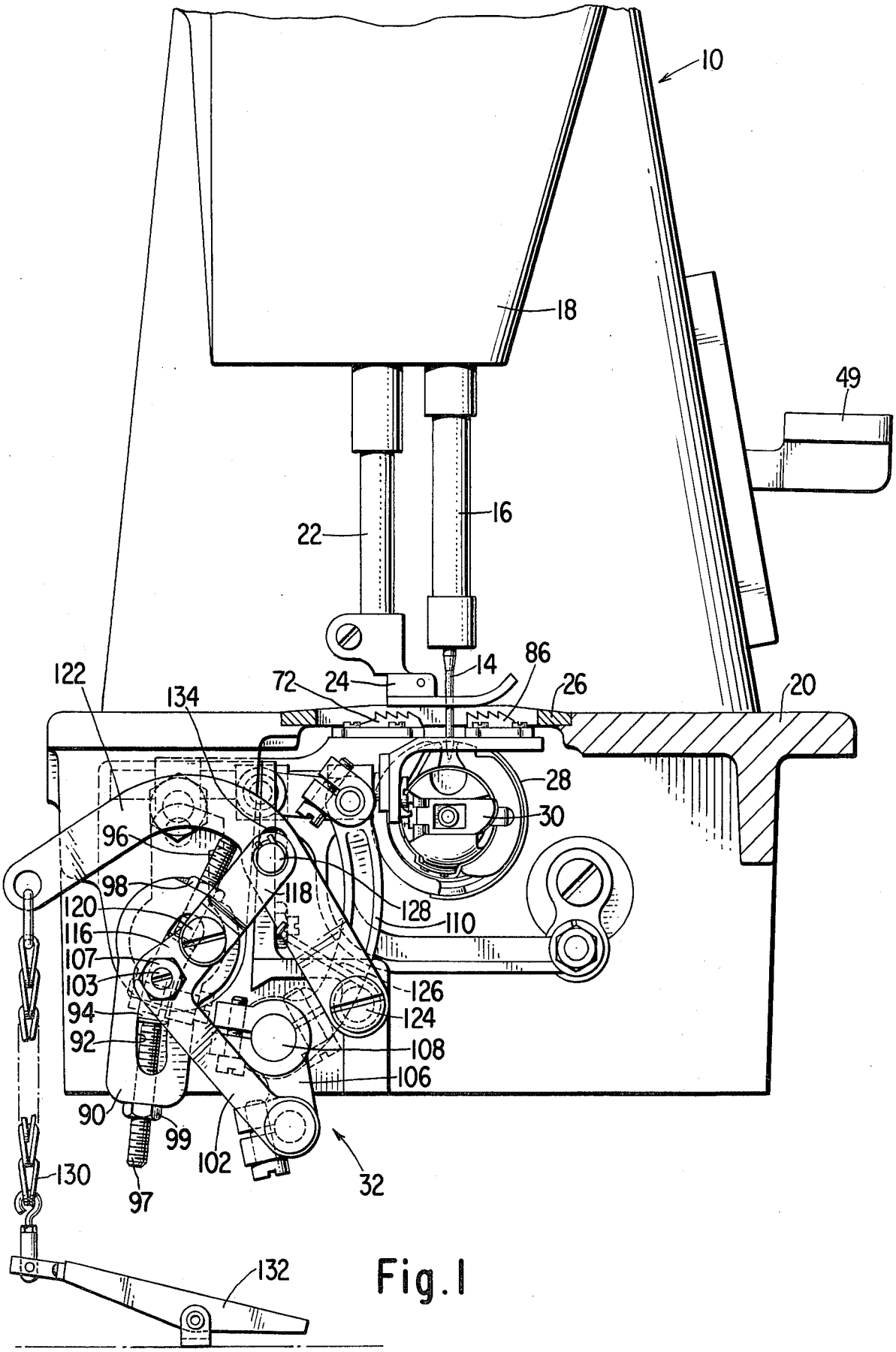
FIG. 1 is an end elevation of a sewing machine in which the invention may be incorporated.

Referring now to the accompanying drawings FIG. 1 illustrates an industrial type sewing machine 10 incorporating the preferred form of the improved auxiliary stitch regulating mechanism of the present invention. The sewing machine includes a needle 14 mounted in a needle bar 16 adapted to be driven at least in endwise reciprocation in a sewing head 18 overlying the work supporting portion of the bed 20. Not shown, is the motor drive which is normally mounted beneath the bed and which generally drives, by means of toothed belts, a bed shaft supported in the sewing machine bed 20. Supported behind the needle bar 16 is a presser bar 22, which presser bar is urged by instrumentalities in the sewing head 18 in a downwardly direction to urge a presser foot 24 downwardly against a work material trapped between it and the throat plate 26 supported in the bed 20 of the sewing machine 10. Visible in the bed 20 is a looptaker 28, which loop-taker may, for example, support a bobbin carrying bobbin case 30 so that the sewing needle 14 may concatenate an upper thread with a lower thread in the formation of a lockstitch. The principle of this invention may, however, apply equally well to chain stitch sewing machines and it is not to be construed as limited to lockstitch machines. Also supported within the bed 20 is a portion of the sewing machine feed system 32, which is more fully disclosed in FIG. 2.

Figure 2:
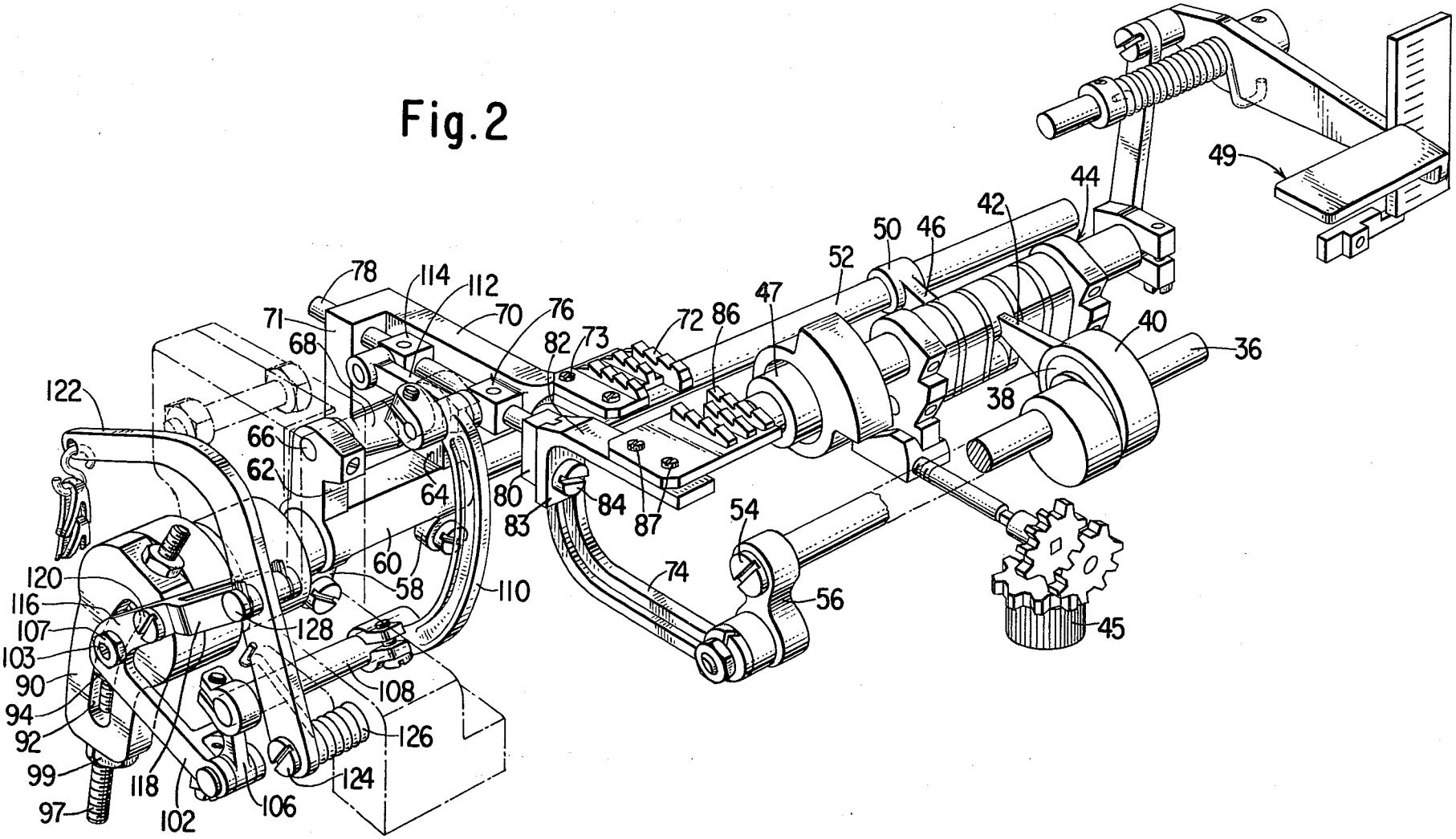
FIG. 2 is an isometric projection of the feed system of the sewing machine shown in FIG. 1; and, FIG. 3 is an elevation of the auxiliary feed regulating system shown in FIGS. 1 and 2, however in an extreme operating position.

Referring now to FIG. 2, there is shown mounted on a bed shaft 36 for rotation therewith a feed advance eccentric 38 which carries and drives an eccentric strap 40 to provide oscillating motion to one end of an integral pitman arm 42 whose other end supplies rocking motion to a toggle type feed regulating member generally indicated at 44. The rocking motion transmitted to the regulating member 44 is adjustably controlled by rotation of knob 45, as is explained in U.S. Pat. No. 4,095, 540, issued on June 20, 1978 to Kaltenbach et al, and assigned to the same assignee as the instant application, which is hereby incorporated by reference herein.

In that patent, there is disclosed external means for adjusting the stitch length regulator and a dynamic damper 47 to counterbalance the toggle feed regulating member 44 so that during reverse feed the vibrations and noise of the system are substantially reduced. Also apparent in FIG. 2 is a reversing lever 49 by which the inclination of the toggle type feed regulating member 44 may be varied at any time by an operator so as to cause the main feeding system of the sewing machine to feed in a reverse direction.

As explained in the above referenced patent, the rocking motion transmitted to the regulating member 44 is adjustably controlled and transferred to one end of an output rocker arm 46 having its other end 50 secured to a feed advance rock shaft 52 journalled in the frame of a sewing machine 10. Also mounted on the rotary bed shaft 36 is a feed lift shaft eccentric 54 which imparts oscillatory rocking motion to an arm 56 which supplies the proper rocking motion for the main feed lift. Secured to the feed advance rock shaft 52 by conventional means, which preferably is illustrated as bifurcated clamps 58, is a rocker arm in the form of a yoke member 60 having a pair of spaced arms 62 and 64. A small stud shaft 66 spans and is secured to arms 62 and 64 for journally supporting a cylindrical hub portion 68 formed on one end of a feed bar 70. The feed bar 70 extends upwardly and forwardly from the hub portion 68 and provides a platform upon which the main feed dog 72 may be fastened by screws 73. The feed bar 70 is further formed with a downwardly and forwardly extending member 74 which is connected at its forward end to the arm 56 supported upon the eccentric 54 mounted on the bed shaft 36. Thus, as the feed advance rock shaft 52 oscillates under the urgings of the toggle type feed regulating member 44, the feed bar 70 is caused to move backward and forward, while rotation of the bed shaft 36 and eccentric 54 attached thereto cause the connecting rod 56 and member 74 to move the feed dog 72 in rising and falling motion.

In addition to that portion 71 of the feed bar 70 extending upwardly from the cylindrical hub portion 68, the feed bar is fashioned with a laterally extending boss 76. The portion 71 and the boss 76 of the feed bar 70 are fashioned with apertures slidably supporting therein an auxiliary feed bar 78. The auxiliary feed bar 78 extends forwardly through these apertures and terminates in a clamp 80 formed with a vertically disposed key in a forward surface thererof. A platform 82 is provided having a rear surface 83, which rear surface is fashioned with a vertically disposed groove to receive the key of the clamp 80. A screw 84 is provided to maintain these surfaces in locked engagement after the elevation of the platform 82 has been established. An auxiliary feed dog 86 may be attached to the platform 82 by screws 87, the screw 84 thus being utilized to maintain the main feed dog 72 and the auxiliary feed dog in the same plane.

Attached to the end of the feed advance rock shaft 52 is an auxiliary feed rock lever 90. The feed rock lever 90 is fashioned with a slot 92 which may be slightly curved. The slot 92 receives a slider 94, whose permissible travel in the slot 92 may be established by screws 96, 97 threadedly extending into the slot and maintained in position by locknuts 98, 99. The slider 94 is connected to a driving crank link 102 by means of stud 103 and locknut 104. The slight curvature of the slot 92 is to accommodate the pivotal motion of the driving crank link 102 when moved to a new position to alter differential feed, as described below. The oscillatory motion of the feed rock lever 90 is transferred by means of the driving crank link 102 to an auxiliary feed driving crank 106. The auxiliary feed driving crank 106 is supported on a shaft 108 journalled in the sewing machine frame, and oscillation of the auxiliary feed driving crank causes the shaft 108 also to oscillate. Attached to the other end of the shaft 108 is an auxiliary feed driving arm 110 which oscillates with the shaft. The opposite end of the auxiliary feed driving arm 110 is connected to one end of a connecting link 112, the opposite end of which is connected to a feed bar guide 114 clamped onto the auxiliary feed bar 78. Thus, as the auxiliary feed rock lever 90 oscillates, and by way of slider 94 and driving crank link 102 causes the auxiliary feed driving crank 106 and shaft 108 also to oscillate, the auxiliary feed driving arm 110 oscillates, and by way of connecting link 112, urges the auxiliary feed bar 78 and auxiliary feed dog 86 in forward and reverse feeding motions with, or slidably with respect to, the main feed bar 70.

Figure 3:
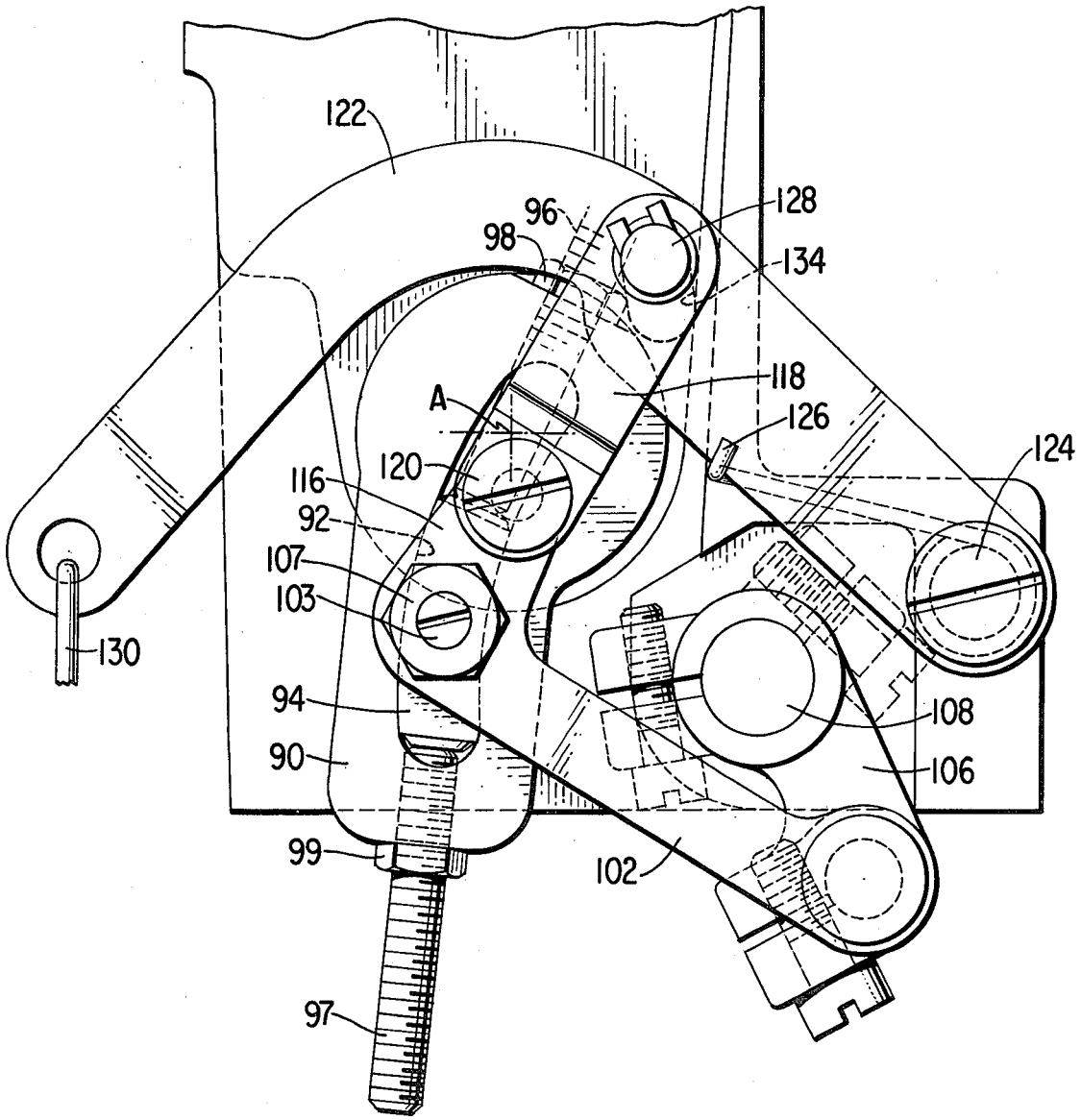

The auxiliary feed system terminating in the auxiliary feed dog 86 is regulated by varying the position of the slider 94 in the slot 92 in the auxiliary feed rock lever 90. In order to accomplish this, the driving crank link 102 is fashioned with an arm 116 extending from the stud 103, which arm is connected to a connecting link 118 by pivot screw 120, the connecting link being bifurcated to span both sides of a feed actuating lever 122. The feed actuating lever 122 is pivoted to the sewing machine frame by pivot screw 124 and is normally biased in a clockwise direction, as viewed in FIG. 3, by torsion spring 126 encircling the pivot screw. The arm 116 of the crank link 102 operates to attenuate the motion experienced by the stud 103 owing to the restraints placed on the motion of the crank link by its connection to the feed driving crank 106.

In the usual construction, the feed actuating lever 122 would be connected to the connecting link 118 by a stud 128 extending through circular apertures in the connecting link and the feed actuating lever. However, in a construction of this sort, a large measure of the vibration and shock from the auxiliary feed rock lever 90 is transmitted through the connecting link 118 to the feed actuating lever 122 and thus through the chain 130 to the foot treadle 132. This continuing source of vibration is very fatiguing to an operator and may well result in a change of setting which may be apparent in the work material. However, by utilizing a round aperture through the connecting link 118 and a slot 134 through the feed actuating lever 122 a degree of vibratory motion may be accommodated without transference of the vibration and shock to the feed actuating lever 122. As the auxiliary feed rock lever 90 oscillates in a counterclockwise direction about the pivot A shown in FIG. 3, the motion imparted to the driving crank link 102 tends to lift the connecting link 118 towards the feed actuating lever 122, while the auxiliary feed dog 86 partakes of a feed advance motion. Thus, while feed advance takes place, the feed actuating lever 122 is urged to its most clockwise position. When the auxiliary feed rock lever 90 returns in a clockwise direction, returning the feed dog 86 to a starting position for another feed advance, the connecting link 118 and stud 128 move downwardly as viewed in FIG. 3, this motion being accommodated by the stud extending through the slot 134 in the feed actuating lever.

Experience has shown that positioning of the slot 134 normal to the connecting link 118 has little or no effect on elimination of the transmission of vibration to the foot treadle. Similarly, with a slot 134 extending substantially in the same direction as the connecting link 118 a problem was encountered with lost motion slowing response, and with not being able to return the slider 94 to the "O" position at A. However, with the slot 134 at an angle to the connecting link 118, the stud 128 is in frictional contact with the upper surface of the slot and has the freedom of motion during the feed return motion to make a slight motion without feedback to the feed actuating lever 122. With the slot 134 at an angle to the connecting link 118, thus, there is no transmission of vibration, lost motion or a positioning problem.

Having thus set forth the nature of the invention what is sought to be claimed is:

1. In an industrial sewing machine with a differential feeding mechanism having an auxiliary feeding mechanism including means for generating variable oscillatory motion, an auxiliary feed dog, means for connecting said variable generating means to said feed dog for feed and return motion thereof, and means for selectively varying said variable generating means comprising: a connecting link having a first end and a second end, with said first end operatively connected to said variable generating means; a feed actuating lever pivotably connected to said sewing machine, said feed actuating lever being formed with a slot; and stud means extending through said second end of said connecting link and said slot of said feed actuating lever, said slot extending in a direction to give the greatest distance from the pivotal connection of said feed actuating lever and from said slider at the extreme thereof effective during feed motion, to the least distance therefrom at the extreme thereof effective for return motion.

2. In an industrial sewing machine with a differential feeding mechanism having an auxiliary feeding mechanism including an auxiliary feed rock lever with a slot extending substantially radially thereof, a slider situated in said slot for selective positioning therein, an auxiliary feed dog, means for connecting said slider to said feed dog for feed and return motion thereof, and means for selectively positioning said slider comprising: a connecting link having a first and a second end with said first end operatively connected to said slider; and a feed actuating lever pivotably connected to said sewing machine, said feed actuating lever being formed with a slot; and stud means extending through the second end of said connecting link and said slot of said feed actuating lever, said slot extending in a direction to give the greatest distance from the pivotal connection of said feed actuating lever and from said slider at the extreme thereof effective during feed motion, to the least distance therefrom at the extreme thereof effective for return motion.

3. In an industrial sewing machine as claimed in claim 2 wherein said means for connecting said slider to said feed dog includes a driving crank link for urging a feed driving crank into oscillatory motion, said driving crank link being operatively connected to said slider and having an extension thereto extending toward said feed actuating lever, said connecting link being pivotably connected to said extension.

* * * * *